United States Patent [19]

Müller et al.

[11] 4,391,536

[45] Jul. 5, 1983

[54] WORD PROCESSOR PRINT WHEEL ASSEMBLY

[75] Inventors: Michael Müller, Wädenswil; Herbert Scherrer, Uster; Erwin Kägi, Volketswil, all of Switzerland

[73] Assignee: Franz Buttner AG, Zurich, Switzerland

[21] Appl. No.: 298,307

[22] Filed: Sep. 1, 1981

[30] Foreign Application Priority Data

Sep. 2, 1980 [CH] Switzerland ..... 6608/80

[51] Int. Cl.[3] ..... B41J 1/30; B41J 27/04

[52] U.S. Cl. ..... 400/144.2; 400/202; 400/470

[58] Field of Search ..... 400/144.2, 174, 175, 400/202–202.4, 470

[56] References Cited

U.S. PATENT DOCUMENTS 381,910 5/1888 Crandall ..... 400/202.2 X 4,018,639 4/1977 Staples, Jr. ..... 400/174 X 4,115,012 9/1978 Ploeger, Jr. et al. ..... 400/202.1

FOREIGN PATENT DOCUMENTS 1561261 2/1970 Fed. Rep. of Germany ... 400/144.2

*Primary Examiner*—Paul T. Sewell

*Attorney, Agent, or Firm*—Karl F. Ross; Herbert Dubno

[57] ABSTRACT

A print wheel assembly for a word processing machine utilizing a daisy wheel-type printer as a type-carrying disk in which the typefaces are mounted upon flexible members generally extending radially from a hub by which the wheel is mounted in the machine. According to the invention, a pigment carrier overlies the typefaces and can be of disk configuration and is so mounted on the wheel as to shift relative to the typefaces, whereby successive impacts are offset from one another for each typeface. The pigment carrier can be a bibulous or capillary fabric drawing ink from a reservoir dimensioned to supply sufficient ink to feed the transfer layer for the duration of the useful life of the wheel.

10 Claims, 2 Drawing Figures

WORD PROCESSOR PRINT WHEEL ASSEMBLY

FIELD OF THE INVENTION

Our present invention relates to word processor print wheels and, more particularly, to print wheels of the radial-eye flexible type designed to produce an image of a typeface upon a paper or other layer upon impact of a machine element against the type-carrying member of the wheel.

BACKGROUND OF THE INVENTION

Modern word processing equipment and especially printers for word processing machines, computer terminals and the like may comprise a so-called print wheel which is constituted by a disk having a hub removably mounted upon the machine and formed with a flexible perimeter provided with a font of typefaces or characters which represent characters programmed in the electronic circuitry of the machine and are adapted to be reproduced upon a paper moved past a platen by a hammer or like member positioned to strike a flexible portion of the wheel, drive the typeface against a pigment carrier such as a ribbon, and thereby reproduce an image of the typeface on the paper.

The flexible perimeter of the wheel may be formed by providing the wheel as a so-called daisy wheel, i.e. forming each typeface upon a respective radial arm or spoke extending outwardly from the hub and thus resiliently displaceable out of the plane of the wheel or disk by the hammer upon impact to print the respective character.

Such wheels may be composed of metal or of a resilient synthetic resin material and generally have a limited life but, because they are of low cost and weight, are able to provide rapid high quality printing in an economical and convenient manner.

As noted, such wheels are conveniently utilized together with a ribbon, band or strip carrying the pigment, e.g. a so-called carbon ribbon, which may be disposable, or even a ribbon which may be reinked after each passage across the wheel. The ribbon can be carried on spools or a cartridge or cassette.

While print wheels of the aforedescribed type have been found to be highly effective in high speed typewriting and print output, especially in association with cassette ribbons, the operating cost of conventional equipment utilizing such print wheels is found to be comparatively high because of the frequent need to replace the ribbon reels. Cassettes have an advantage over reel-type ribbons since they can contain the reinking supply in such manner that replacement of the ribbon is possible, together with the reinking supply as a unit, without soiling the hands of the operator. However, the cassettes themselves are fairly complex, expensive to manufacture and, therefore, expensive to replace.

The print wheels, whether composed of synthetic resin material or metal, must be replaced upon rupture of one of the spokes or damage to or wear of a typeface. Generally speaking such wheels can be readily removed from the machine by the operator and replaced by another wheel kept on hand for this purpose.

OBJECTS OF THE INVENTION

It is the principal object of the present invention to provide an improved print wheel assembly which enhances the versatility of spoke-type or daisy wheels and solves other problems in the operation of word processing machines as discussed above.

Another object of the invention is to provide a simplified system for replacing and handling the ink-carrying member in a daisy wheel printer of the aforedescribed type.

Yet another object of the invention is to reduce the operating cost of a word processing machinery utilizing flat or disk-shaped printing wheels.

SUMMARY OF THE INVENTION

These objects and others which will become more readily apparent hereinafter are attained, in accordance with the invention, in a composite print wheel which comprises, in addition to the spoked disk formed with the usual font of typefaces, an ink-carrying layer or flat member overlying all of the typefaces and disposed at one side of the disk, namely, the side turned toward the paper and the platen of the machine and which is adapted to transfer an image of an imparted typeface to the paper. According to the invention, means is provided whereby the position juxtaposed with each typeface of the pigment-carrying layer shifts relative to the typeface upon each printing operation.

Thus relative shifting of the layer and the disk is effected upon each impact.

As a result of the fact that the typeface wheel and the layer form a composite print wheel which can be replaced as a unit upon failure of the disk or failure of the ink supply, the replacement of the single element capable of wear in the printer is possible in a highly convenient and economical manner, the assembly being disposable and of comparatively low cost.

According to the invention, the print wheel assembly of the invention includes, in addition to the aforementioned layer, a reservoir of coloring material or "ink" which is preferably located in the region of the hub of the assembly and which communicates with the layer which can be composed of a porous or bibulous material tending to extract the coloring material, which can be in fluid form, from the reservoir by capillary action or wicking action.

The porous material can be a nonwoven fabric, e.g. a felt, a reticulate material such as a synthetic resin foam or any other relatively thin layer-forming material having the capillary or bibulous characteristics mentioned previously. The reservoir also may be a porous synthetic resin impregnated with the ink.

According to the invention, moreover, the layer can be formed with an upper and a lower disk of a material which is not penetrated by or permeable to the coloring material, e.g. of a synthetic resin foil such as a polyethylene, which enables the assembly to be handled without soiling the hands of the operator and which prevents deterioration of the pigmentations material.

The protective foil disks can cover the layer and, if desired, the reservoir. The lower foil disk is dimensioned to terminate inwardly of the typeface, i.e. so as not to cover the typefaces, being removable once the wheel assembly has been mounted in the machine.

Generally the foam reservoir should be dimensioned to accommodate sufficient pigmentatious material to supply the transfer layer for at least the average life of the type-carrying disk.

An excess of the pigmentatious material can be provided, if desired, to ensure the availability of the inking should the type-carrying disk last for an unusually long number of impacts.

The transfer layer can be composed of a flat textile material which is impregnated with typewriter-ribbon or printing ink and the material can be any of the fabrics which has been found applicable heretofore for high quality typewriter ribbons. Any other flat material capable of transferring a high quality of imprint can be used as well as long as the material can carry and deliver the necessary amount of ink and has the strength to resist penetration by the typefaces.

When the assembly is formed with an ink reservoir, the transfer layer is advantageously formed at least in part by a fabric having a high degree of capillarity capable of delivering the ink to the striking surfaces.

The transfer layer, according to the invention, can have the configuration of a full circular disk of the same diameter as the type-carrying disk or can be interrupted at its center, i.e. formed with a hole. What is important, however, is that it overlie all of the typefaces and, when a color reservoir is provided, communicate therewith so that the coloring material can flow to the impact regions.

It is also important, for the purposes of the present invention, that the transfer layer be capable of rotating relative to the type-carrying layer. For example, the transfer layer may be freely rotatable on the type-carrying disk or can be shiftable relative to the latter in a forcible manner by appropriate means. It is important that the layer not follow all movements of the disk precisely so that successive impacts from each typeface do not occur at precisely the same point of the layer.

This relative displacement with each impact may be effected by inertia, i.e. by permitting the transfer layer to slip behind the rotation of the type-carrying disk when the latter is positively driven to align the respective typefaces at the impact locations. This avoids multiple impacts at regions at which ink has already been transferred and hence precludes the fading of the transferred images.

Other means of ensuring the relative angular displacement of the transfer layer and the type-carrying wheel can be assured by providing vibration of the transfer layer, e.g. enabling a cam on the type-carrying wheel to intermittently strike the transfer layer, or by providing indexing means which positively steps the ink-carrying layer relative to the type-carrying disk during rotation of the latter. Such means can include vanes, ribs, camming members, pawls, indexing teeth, ratchet arrangements, detent recesses or the like. In general any means capable of stepping one rotatable member relative to an adjacent rotatable member can be used.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
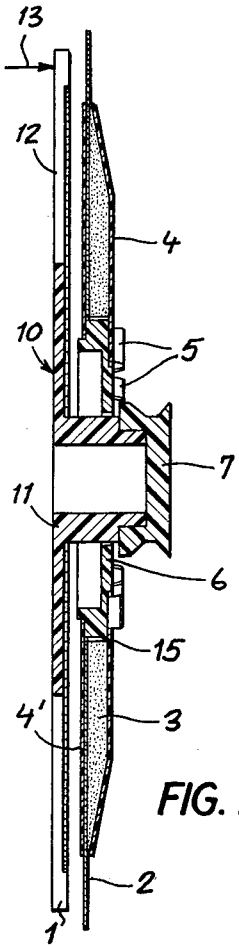
FIG. 1 is a cross-sectional view taken in a plane perpendicular to the plane of the assembly of the present invention along the axis thereof.

The print wheel assembly of the present invention comprises a synthetic resin type-carrying disk 10 formed with a hub 11 and radial spokes 12, the outer end of each of which is provided with a typeface and may be enlarged as shown in FIG. 1 so that impact can be applied in the direction of arrow 13 to produce an image of the typeface upon a sheet of paper ahead of a platen in a word processing printer.

The spokes 12 may extend outwardly from a disk-shaped inner portion 14 which is integral, i.e. molded unitarily with the hub 11, the spokes 12 and typefaces 1. While one circular array of typefaces makes up the font of this wheel, it is also possible to provide two or more typefaces on each spoke if desired or to provide other characters rather than the alpha-numeric characters shown for special character wheels. The term "typefaces" and reference to a "font" thus are intended to indicate any printing characters which can be formed on the ends of the spokes of such a wheel.

Member 14 and the spokes lie in a common plane and, upon impact, each spoke is deflectible in the direction of the arrow 13 to effect a printing action.

Figure 2:
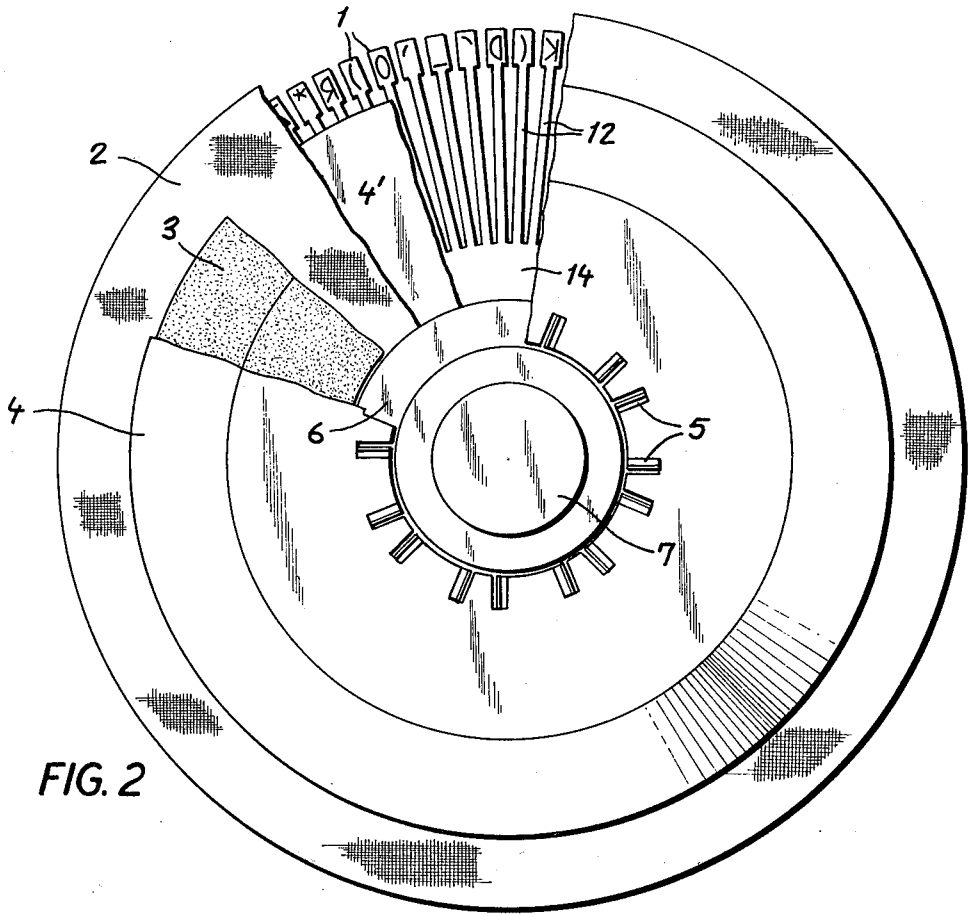
FIG. 2 is a plan view of the assembly partly broken away.

The assembly also comprises a layer 2 overlying the typefaces and are here shown to be in the form of an annular disk (FIG. 2) having a central hole 15 which fits onto a core 6 rotatable on the hub 11.

The thin layer 2 can be formed from any fabric material commonly used as typewriter ribbon material and have a high degree of capillarity of a bibulous character so that its wicking properties enables ink to be drawn from a color reservoir 3. The color reservoir 3 can be formed by a foil of synthetic resin material as shown at 4 enclosing a foam synthetic resin body, e.g. of polyurethane, whose reticulate structure defines pores filled with the ink and overlying the fabric layer 2, the outer diameter of which is at least equal to the outer diameter of the array of typefaces. Since the wicking properties of the fabric layer 2 are greater than that of the ink reservoir, as ink is depleted from the fabric layer 2, it is replenished from the reservoir. The foil 4 prevents contamination of the fingers of the user and a similar layer 4' can be provided on the underside of the reservoir, both layers terminating inwardly of the array of typefaces.

The hub carries a handling knob 7 to facilitate replacement of the assembly in the machine and foil 4' also precludes contamination of the type-carrying disk.

Radial vanes 5 extending from the carrier 6 of the layer 2 can engage a part of the machine (not shown) so that rotation of the disk 10 relative to the carrier in the manner previously described is possible, the core 6 being held axially in place by the knob 7.

The assembly can be packaged in the usual protective container which can be hermetically sealed to prevent the ink from drying out until the print wheel assembly is inserted in the machine.

We claim:

1. A print wheel assembly for a printer of a word processing machine or the like, comprising:

a type disk formed unitarily with a hub and a peripheral array of laterally deflectible typefaces connected to said hub;

an annular color-transfer layer connected to said disk and overlying said typefaces for juxtaposition with a paper onto which images of said typefaces are to be transferred by impact, said transfer layer being provided on a carrier rotatably mounted on said hub and angularly shiftable relative to said disk upon rotation thereof to offset successive points of contact between said typefaces and the layer; and an annular reservoir on said carrier and rotatably mounted thereby on said disk containing flowable coloring material and connected to said layer for transferring said material to said layer, said reservoir containing a porous material impregnated with said coloring material.

2. The assembly defined in claim 1 wherein said reservoir is dimensioned to contain at least sufficient coloring material to supply said transfer layer for the average useful life of said disk.

3. The assembly defined in claim 1 wherein said transfer layer consists of an ink-impregnated fabric.

4. The assembly defined in claim 1, further comprising an impenetrable foil covering overlying at least part of said color transfer layer for preventing operator contact therewith.

5. The assembly defined in claim 4 wherein said foil covering terminates inwardly of said array of typefaces.

6. The assembly defined in claim 4 wherein said layer is flanked by such foil coverings.

7. The assembly defined in claim 1 wherein said layer is composed of a material capable of drawing coloring material from said reservoir by capillary action.

8. The assembly defined in claim 1 wherein said layer is mounted on said hub of said disk so as to rotate relative thereto by inertia.

9. The assembly defined in claim 1, further comprising mechanical members for angularly stepping said layer relative to said disk.

10. The assembly defined in claim 1, further comprising an impenetrable layer disposed between said transfer layer and said disk inwardly of said array of typefaces.

* * * * *